US008271344B1

(12) United States Patent
Channakeshava et al.

(10) Patent No.: US 8,271,344 B1
(45) Date of Patent: Sep. 18, 2012

(54) BUDGET DRIVEN PURCHASE MONITOR

(75) Inventors: Girish Mallenahally Channakeshava, Bangalore (IN); Arien C. Ferrell, Sunnyvale, CA (US)

(73) Assignee: Intuit Inc., Mountain View, CA (US)

( * ) Notice: Subject to any disclaimer, the term of this patent is extended or adjusted under 35 U.S.C. 154(b) by 395 days.

(21) Appl. No.: 12/607,755

(22) Filed: Oct. 28, 2009

(51) Int. Cl.
*G06Q 30/00* (2012.01)

(52) U.S. Cl. ..... 705/26.1; 705/26.4; 705/26.5; 705/27.2; 705/1.1; 705/400; 707/E17.079; 707/999.05

(58) Field of Classification Search ..... 705/26.1, 705/26.5, 27.2, 1.1, 400, 26.4; 707/E17.079, 707/999.05
See application file for complete search history.

(56) References Cited

U.S. PATENT DOCUMENTS 6,330,542 B1 * 12/2001 Sevcik et al. ..... 705/7.26
2002/0019753 A1 * 2/2002 Boden ..... 705/3
2006/0047588 A1 * 3/2006 Lal et al. ..... 705/30
2006/0173767 A1 * 8/2006 Hansen ..... 705/35
2008/0177639 A1 * 7/2008 Kuppersmith et al. ..... 705/27
2009/0254447 A1 * 10/2009 Blades ..... 705/26

OTHER PUBLICATIONS

Checkbook; Ultrasoft Checkbook, Copyright 2001-2004, extracted on Internet from Google search engine on Jan. 19, 2012.*

* cited by examiner

*Primary Examiner* — Yogesh C Garg
(74) *Attorney, Agent, or Firm* — Osha Liang LLP

(57) ABSTRACT

The method for conducting a purchase involves obtaining a target item specification for purchasing a target item, wherein the target item specification comprises a target item description, a target purchase date, and a target price, obtaining, using a central processing unit (CPU), candidate item information related to a candidate item found on a merchant site consistent with the target item specification, wherein the candidate item information comprises a candidate item description and a candidate item price, populating a categorized entry in a user budget using the candidate item price and the target purchase date, wherein the candidate item price is no more than the target price, updating, using the CPU, the budget based on user transactions, generating a result by analyzing, using the CPU, the user budget with respect to the categorized entry, and submitting the result to a user for formulating a decision regarding whether to purchase the candidate item.

20 Claims, 6 Drawing Sheets

BUDGET DRIVEN PURCHASE MONITOR

BACKGROUND

A budget generally refers to a list of all planned expenses and revenues (or incomes) for a particular time period (i.e., budget cycle). The budget cycle is typically a period in the future, for example a month, a quarter, or a year. A budget typically helps an individual or a business determine when income will be sufficient to cover expenses and help forecast when a large expenditure (e.g., a purchase of products, services, etc.) can be made.

Price erosion is a result of market competition, technology maturity, etc. that causes the price of a product, service, or other items to decrease in time. As a result, a purchase planned in the future can often be made at a lower price than the current price when the budget is initially created.

Electronic Commerce, commonly known as e-commerce, involves buying and selling of products, services, or other items over electronic systems such as the Internet and other computer networks. Vendors that participate in the e-commerce are referred to as e-commerce merchants.

SUMMARY

In general, in one aspect, the invention relates to a method for conducting a purchase involving obtaining a target item specification for purchasing a target item, wherein the target item specification comprises a target item description, a target purchase date, and a target price, obtaining, using a central processing unit (CPU), candidate item information related to a candidate item found on a merchant site consistent with the target item specification, wherein the candidate item information comprises a candidate item description and a candidate item price, populating a categorized entry in a user budget using the candidate item price and the target purchase date, wherein the candidate item price is no more than the target price, updating, using the CPU, the budget based on user transactions, generating a result by analyzing, using the CPU, the user budget with respect to the categorized entry, and submitting the result to a user for formulating a decision regarding whether to purchase the candidate item.

In general, in one aspect, the invention relates to a computer readable medium storing instructions when executed by the computer comprising functionalities for obtaining a target item specification for purchasing a target item, wherein the target item specification comprises a target item description, a target purchase date, and a target price, obtaining, using a central processing unit (CPU), candidate item information related to a candidate item found on a merchant site consistent with the target item specification, wherein the candidate item information comprises a candidate item description and a candidate item price, populating a categorized entry in a user budget using the candidate item price and the target purchase date, wherein the candidate item price is no more than the target price, updating, using the CPU, the user budget based on user transactions, generating a result by analyzing, using the CPU, the user budget with respect to the categorized entry, and submitting the result to a user for formulating a decision regarding whether to purchase the candidate item.

In general, in one aspect, the invention relates to a system for conducting a purchase. The system includes an electronic commerce merchant accessible via a computer network and comprising candidate items for purchase by a user, a budget generator executing on a central processing unit (CPU) and configured to generate a user budget for the user, a candidate item monitor executing on the CPU and configured to obtain candidate item information related to a candidate item of the electronic commerce merchant consistent with a target item specification for purchasing a target item, wherein the target item specification comprises a target item description, a target purchase date, and a target price, wherein the candidate item information comprises a candidate item description and a candidate item price, a memory storing instructions when executed by the CPU comprising functionalities for populating a categorized entry in a user budget using the candidate item price and the target purchase date, wherein the candidate item price is no more than the target price, updating the user budget based on a modification of the candidate item information, generating a result by analyzing the user budget with respect to the categorized entry, and submitting the result to the user for formulating a decision regarding whether to purchase the candidate item.

Other aspects of the invention will be apparent from the following description and the appended claims.

DETAILED DESCRIPTION

Figure 1A:
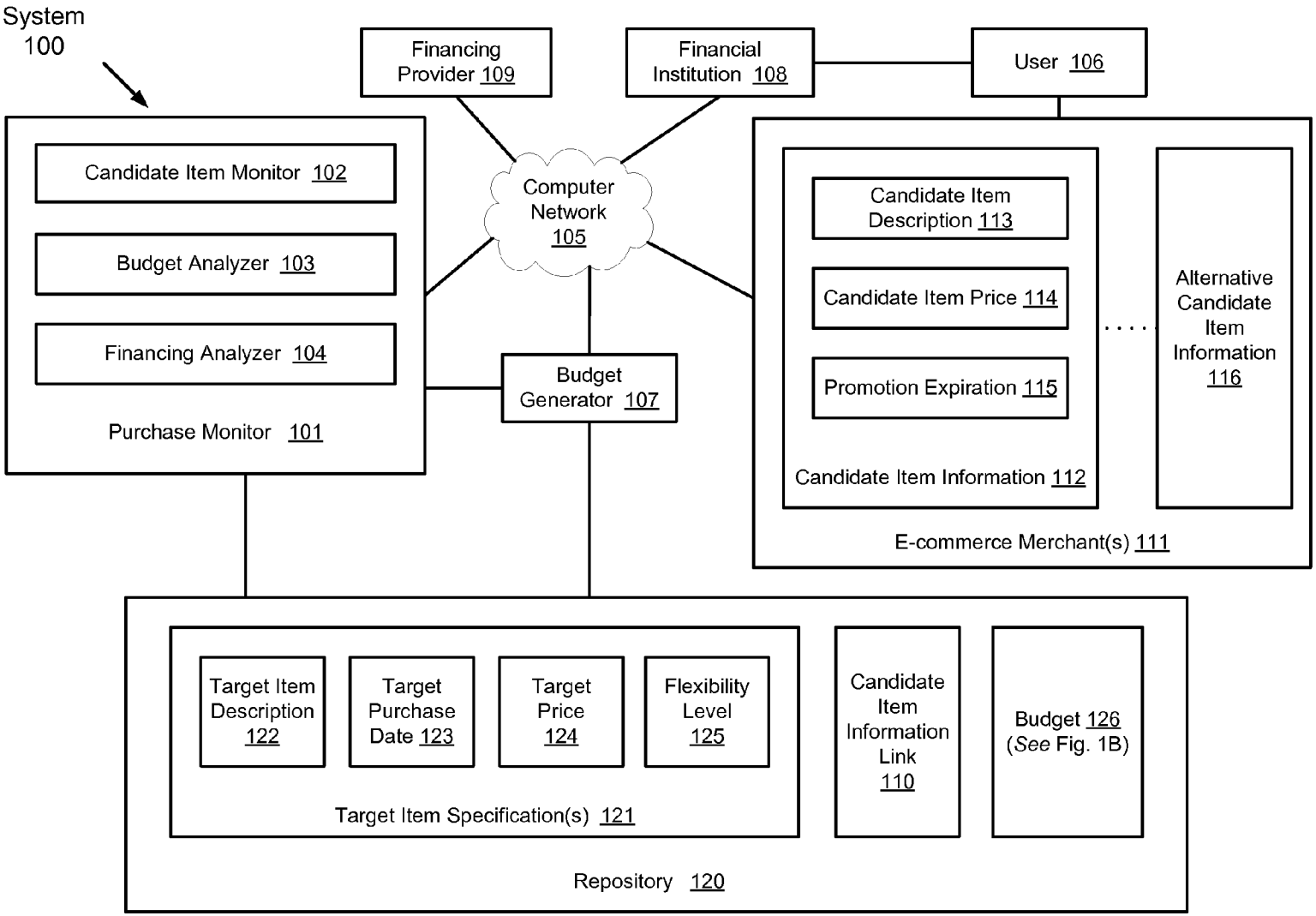
FIGS. 1A and 1B depict a block diagram of a system in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention provide a system and method for monitoring a budget of a user (also referred to as user budget) and a market price of an item the user intends to purchase. More specifically, the market price of the item is included as a categorized expense entry in the budget that is updated by monitoring vendor offerings of the item(s) in accordance with one or more embodiments of the invention. The monitoring may occur regularly (e.g., each second, hourly, daily, weekly, monthly, quarterly, or based on other periodic basis) or continuously. As the monitoring determines changes in price of the item, in some embodiments of the invention the price of the item is adjusted as well. Should the price adjust favorably to the user, in some embodiments of the invention the user will receive a notification that a purchase can be made at the new item price. Depending on the context used in the description below, "target item" generally refers to an item that the user intends to purchase, while a "candidate item" generally refers to an item offered by a vendor that matches a user-provided specification for the target item.

Figure 1B:
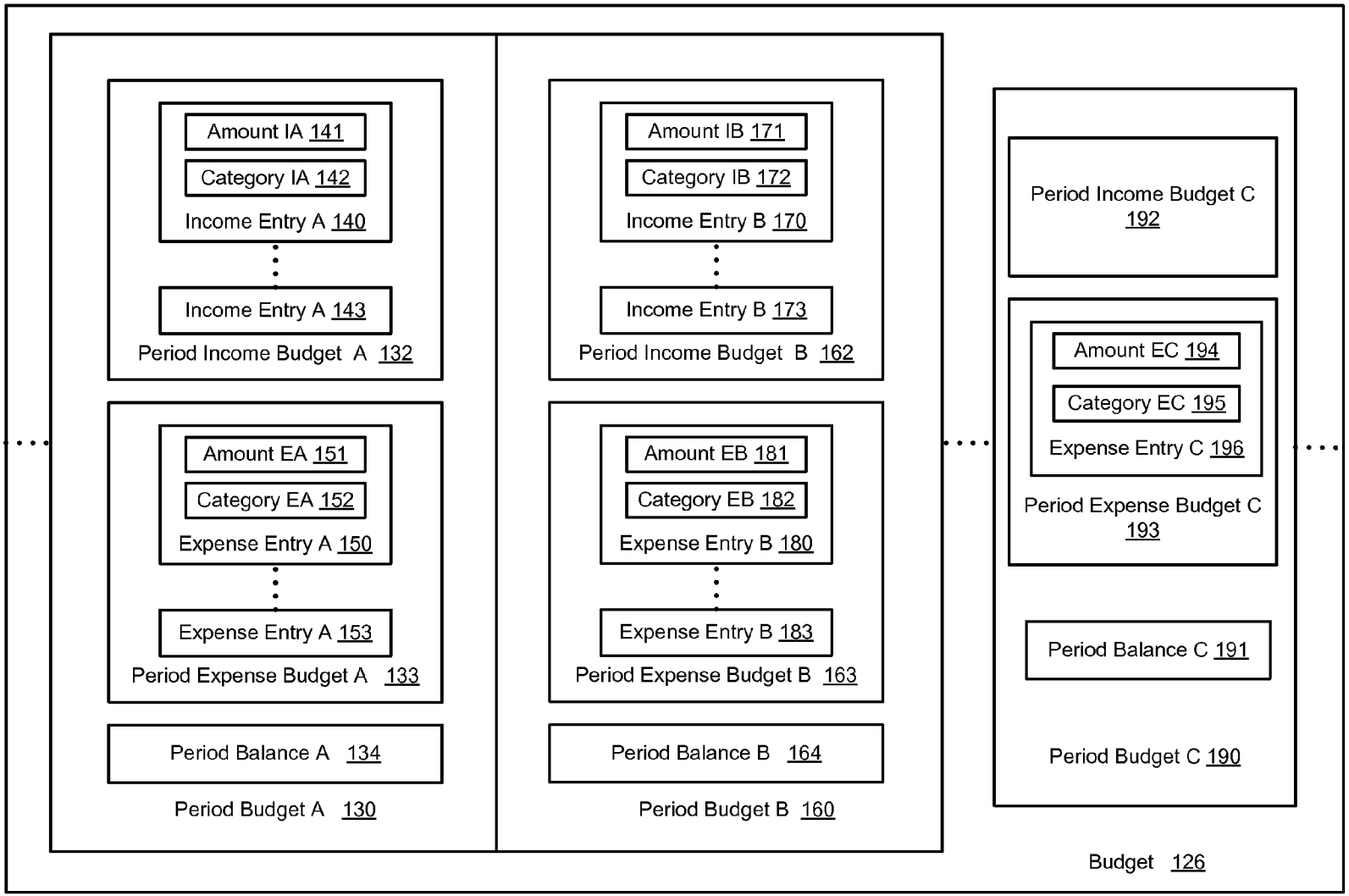

FIGS. 1A and 1B depict a block diagram of a system (100) in accordance with one or more embodiments of the invention. For clarity of illustration, FIGS. 1A and 1B are depicted on two sheets. Those skilled in the art, having the benefit of this detailed description, will appreciate the components shown in FIGS. 1A and 1B may differ among embodiments of the invention, and that one or more of the components may be optional. In one or more embodiments of the invention, one or more of the components shown in FIGS. 1A and 1B may be omitted, repeated, supplemented, and/or otherwise modified from that shown in FIGS. 1A and 1B. Accordingly, the specific arrangement of components shown in FIGS. 1A and 1B should not be construed as limiting the scope of the invention.

As shown in FIG. 1A, the system (100) includes a purchase monitor (101), a budget generator (107), a user (106), one or more e-commerce merchants (111), a computer network (105), and a repository (120). Optionally, a financial institution (108) and a financing provider (109) may also be included. In one or more embodiments of the invention, the purchase monitor (101) further includes a candidate item monitor (102), a budget analyzer (103), and a financing analyzer (104) while the repository (120) stores various data used by the purchase monitor (101), which includes a target item specification (121), a candidate item information link (110), and a budget (126), which is further shown in FIG. 1B and described below.

Generally speaking, the e-commerce merchants (111) offer various products, services, or other items for sale by posting relevant information online that is accessible to the user (106) via the computer network (105). From time to time, some of the products, services, or other items offered by the e-commerce merchants (111) may meet the requirements to be purchase candidates for purchase by the user (106). The posted online information of such purchase candidates may be referred to as candidate item information (e.g. candidate item information (112), alternative candidate item information (116)). Typically, each of the candidate item information (e.g. candidate item information (112), alternative candidate item information (116)) may include a candidate item description (113) and a candidate item price (114).

Generally speaking, the user (106) may be an individual, a business, or other entities while the target item specification (121) may be related to planning by the user (106) for one or more certain future purchase(s) for which a portion of the budget (126) is designated. In one or more embodiments of the invention, the target item specification (121) may include a target item description (122) and a target purchase date (123). Generally speaking, the target item description (122) describes the name, type, model, version, specification, and/or other requirements of an item. For example, the target item description (122) may be related to a product, service, or other items for purchase and the target purchase date (123) may be related to the planned future purchase date. In one or more embodiments, the target item specification (121) further includes a target price (124). For example, the target price (124) may be an initial target price the user (106) plans to pay for the purchase. In one or more embodiments, the target item specification (121) further includes a flexibility level (125) relating to a level of flexibility in the target item description (122), the target purchase date (123), and/or the target price (124). For example, the flexibility level (125) may be related to the level of individual's or business's flexibility (e.g., high, medium, low, strong, weak, heavy, light, or other flexibility criterion) in requiring the exact specification of the item for purchase, the exact schedule that the purchase has to be made, and the exact upper limit of a price to be paid for the purchase.

In one or more embodiments of the invention, the budget (126) may be staged based on consecutive accounting periods (not shown) in the budget cycle. Referring now to FIG. 1B, the budget (126) may include multiple period budgets (e.g. Period Budget B (160) or Period Budget C (190)), each representing the planned incomes and expenses during one of the accounting periods. For example, the budget (126) may be an annual budget implying that the budget cycle is a year, which is divided into consecutive accounting periods, such as monthly or quarterly accounting periods. In one or more embodiments, the accounting periods may each be considered as a separate individual budget cycle by itself and include lower level accounting periods. Accordingly, the budget (126) may have a hierarchical structure that can be rolled up or down (e.g. revealed or concealed) to a selected level of accounting period for analysis/review based on the focus of the user. For example, the annual budget may include the quarterly budgets while each quarterly budget includes monthly budget and the annual budget may be reviewed and/or analyzed at quarterly level or monthly level. In one or more embodiments, the budget (126) also includes actual period budgets (e.g. Period Budget A (130)) representing actual incomes and expenses for those accounting periods that has ended in the budget cycle. For example, the actual period budget (e.g. Period Budget A (130)) and the period budget (e.g. Period Budget B (160)) correspond to the same accounting period that has ended.

In one or more embodiments of the invention, the period budget (e.g. Period Budget B (160), Period Budget C (190)) includes a period income budget (e.g. Period Income Budget B (162), Period Income Budget C (192)), a period expense budget (e.g. Period Expense Budget B (163), Period Expense Budget C (193)), and a period balance (e.g. Period Balance B (164), Period Balance C (191)) while the actual period budget (e.g. Period Budget A (130)) includes an actual period income (e.g. Period Income Budget A (132)), an actual period expense (e.g. Period Expense Budget A (133)), and an actual period balance (e.g. Period Balance A (134)).

For example, continuing with FIG. 1B, the period balance (e.g. Period Balance B (164)) may be derived by adding a period balance of a preceding accounting period (not shown) and the period income budget (e.g. Period Income Budget B (162)) then subtracting the period expense budget (e.g. Period Expense Budget B (163)) where the preceding accounting period is immediately prior to the accounting period with which the period budget (e.g. Period Budget B (160)) is associated. In particular, the preceding accounting period of the leading (i.e., first) accounting period (not shown) in the (current) budget cycle is the ending accounting period (not shown) of a previous budget cycle (not shown) where the period balance of such ending accounting period is the initial balance of the (current) budget cycle. One skilled in the art will recognize that the period balance (e.g. Period Balance B (164), Period Balance C (191), or other balance) of each period budget (e.g. Period Budget B (160), Period Budget C (190), or other budget) for each associated accounting period may be recursively derived from each period income budget (e.g. Period Income Budget B (162), Period Income Budget C (192), or other income budget), each period expense budget (e.g. Period Expense Budget B (163), Period Expense Budget C (193), or other expense budget), and the initial balance of the budget cycle. Further, in one or more embodiments, the initially derived period balance of each period budget (e.g. Period Budget B (160), Period Budget C (190), or other period budget) associated with the current or future accounting periods may be recursively updated when actual incomes and expenses occur or are accrued in the current or prior accounting periods. Alternatively, in one or more embodiments, such updates may be based on the actual period balance (e.g. Period Balance A (134)) of an accounting period when the accounting period ends. In either case, the period balances of all future period budgets associated with future accounting periods are updated to reflect such effects of actual incomes and expenses.

Continuing with FIG. 1B, in one or more embodiments of the invention, the period budget (e.g. Period Budget B (160), Period Budget C (190)) and the actual period budget (e.g. Period Budget A (130)) may be categorized. In other words, all planned or actual incomes and expenses during an accounting period may be categorized in multiple entries each tagged with a pre-defined category. Common categories for a personal budget may include salary income, investment income, household expense, mortgage expense, auto expense, medical expense, etc. Common categories for a business budget may include sales revenue, investment income, marketing expense, etc. In one or more embodiments, planned or actual incomes and expenses within each category may be further categorized into one or more levels of sub-categories. For example, investment income may be further categorized into interest income and rental income while household expense may be further categorized into grocery, utility, entertainment, etc.

As shown in FIG. 1B, the period expense budget (e.g. Period Expense

Budget C (193)) includes the expense entry (e.g. Expense Entry C (196)) having an amount (e.g. Amount EC (194)) and a category (e.g. Category EC (195)); the period income budget (e.g. Period Income Budget B (162)) includes income entries (e.g. Income Entry A (170), Income Entry B (173), or other income entry) while the Income Entry A (170) includes an amount (e.g. Amount IB (171)) and a category (e.g. Category IB (172)); the period expense budget (e.g. Period Expense Budget B (163)) includes expense entries (e.g. Expense Entry B (180), Expense Entry B (183), or other expense entries) while the Expense Entry B (180) includes an amount (e.g. Amount EB (181)) and a category (e.g. Category EB (182)); the actual period income (e.g. Period Income Budget A (132)) includes income entries (e.g. Income Entry A (140), Income Entry A (143), and other income entries) while the Income Entry A (140) includes an amount (e.g. Amount IA (141)) and a category (e.g. Category IA (142)); the actual period expense (e.g. Period Expense Budget A (133)) includes expense entries (e.g. Expense Entry A (150), Expense Entry A (153), and other expense entries) while the Expense Entry A (150) includes an amount (e.g. Amount EA (151)) and a category (e.g. Category EA (152)). In one or more embodiments of the invention, the budget (126) may be modified to focus on various aspects of the incomes and expenses of the user (106 in FIG. 1A). For example, a portion of the pre-defined categories may be selected by the user (106 in FIG. 1A) to be included in or excluded from the budget (126).

Although the budget (126) is shown to be organized in a specific format, those skilled in the art will appreciate that a portion or the entire budget (126) may be organized in various formats different than that depicted in FIG. 1B. For example, various data structures such as table, file, database, linked list, hierarchical graph, etc. may be used for organizing the budget (126).

Figure 4:
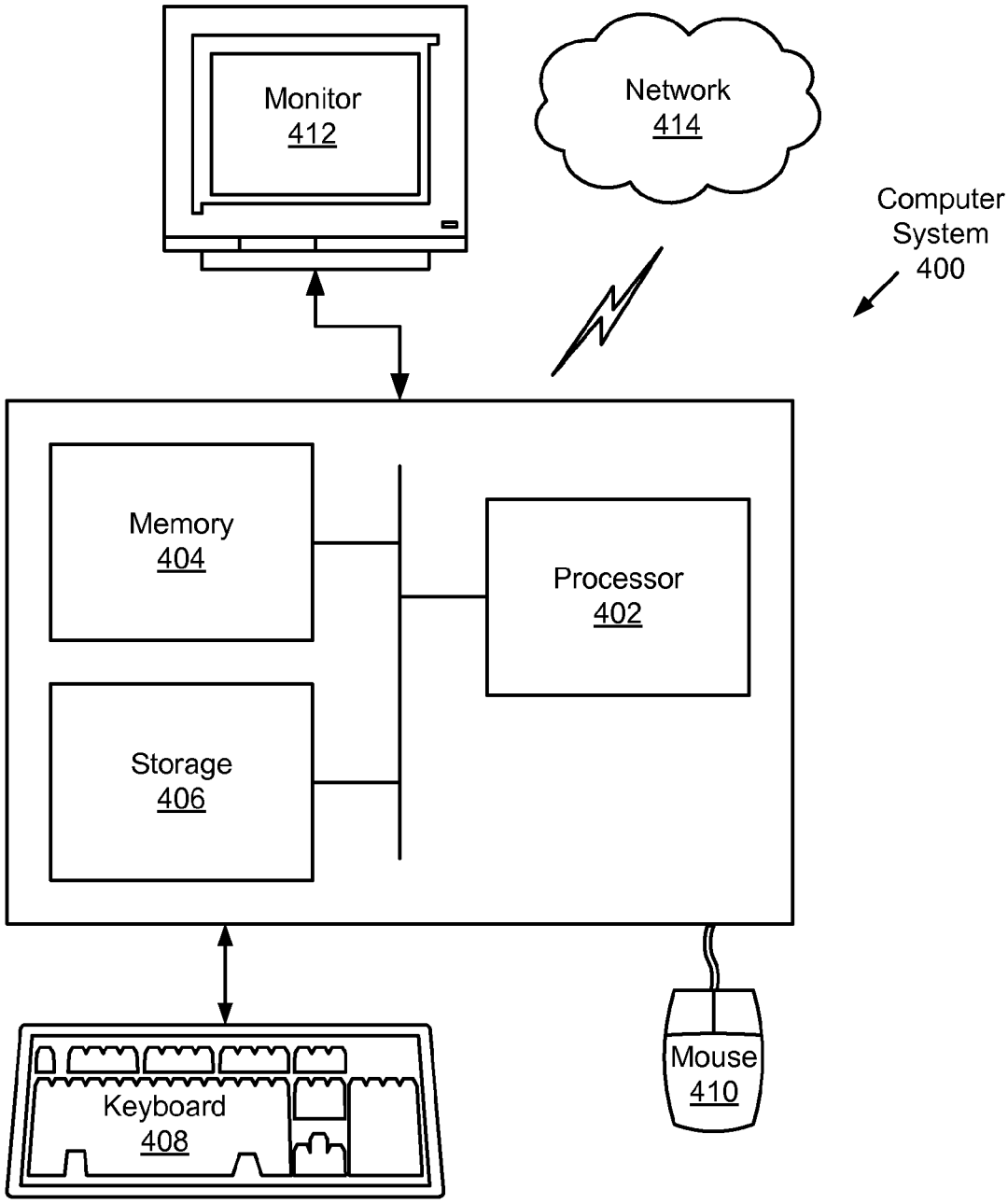
FIG. 4 depicts a computer system in accordance with one or more embodiments of the invention.

Returning to FIG. 1A, the budget generator (107) executes on a processor of a computer system (as shown in FIG. 4) and is configured to generate the budget (126) based at least on user inputs and/or historic data of the user (106) in accordance with one or more embodiments of the invention. For example, the various components in the budget (126) depicted in FIG. 1B may be manually entered by the user (106), automatically generated based on historic income/expense data (e.g., prior year actual incomes and expenses), or combinations thereof. In one or more embodiments, the historic income/expense data may be obtained, via the computer network (105), by the budget generator (107) from a financial institution (108) where the user (106) may hold one or more accounts. For example, the computer network (105) may be the Internet, a financial network, or any other captive or public computer network.

Consistent with the discussion of the budget (126) above, in one or more embodiments of the invention, the budget generator (107) is configured to update the budget (126) to reflect actual incomes and expenses as transactions (or user transactions) occur or are accrued. Alternatively, in one or more embodiments of the invention, the budget generator (107) is configured to update the budget (126) to reflect actual incomes and expenses when an accounting period ends.

In one or more embodiments of the invention, the budget generator (107) is further configured to include the target item specification (121) in the budget (126), for example, based on input from the user (106). In one or more embodiments, the target item specification (121) may be included in the budget (126) as an expense entry (e.g. Expense Entry C (196 in FIG. 1B)) of the period expense budget (e.g. Period Expense Budget C (193 in FIG. 1B)) that is associated with an accounting period in which the target purchase date (123) falls. Such accounting period is referred to as the scheduled purchase period. In one or more embodiments, a target item category may be added in the budget (126) for considering future purchase(s) of products, service, or other items. Accordingly, an amount (e.g. Amount EC (194 in FIG. 1B)) of the expense entry (e.g. Expense Entry C (196 in FIG. 1B)) is assigned the target price (124) and the category (e.g. Category EC (195 in FIG. 1B)) of the expense entry (e.g. Expense Entry C (196 in FIG. 1B)) is assigned the target item category. In the example of multiple target items, the category (e.g. Category EC (195 in FIG. 1B)) of the expense entry (e.g. Expense Entry C (196 in FIG. 1B)) may be assigned one of several sub-categories of the target item category where each of the sub-categories may be associated with a particular target item. In one or more embodiments, the target price (124) assigned to the amount (e.g. Amount EC (194 in FIG. 1B)) may have an initial value and be subsequently updated based on market price, obtained, for example, from the e-commerce merchants (111). Also, for example, the initial value may be an initial target price the user (106) plans to pay for the purchase or a place holder just until updated using the market price.

As discussed above in relation to FIG. 1A, the purchase monitor (101) includes the candidate item monitor (102), the budget analyzer (103), and the financing analyzer (104) in accordance with one or more embodiments of the invention. In one or more embodiments, the purchase monitor (101) executes on a processor of a computer system (as shown in FIG. 4) and is configured to monitor the period balances in the budget (126) with respect to the target item specification (121) and search for products, services, or other items from the e-commerce merchants (111) that may be considered for purchase to meet the requirement of the target item specification (121).

In one or more embodiments of the invention, the budget analyzer (103) is configured to monitor the period balances of the budget (126) as actual incomes and expenses are used to update the period balances of all future period budgets associated with future accounting periods. As discussed above, the actual period balance (e.g. Period Balance A (134 in FIG. 1B)) replaces the period balance (e.g. Period Balance B (164 in FIG. 1B)) in the recursive derivation of the period balance (e.g. Period Balance C (191 in FIG. 1B)), for example when the accounting period associated with the period budget (e.g.

Period Budget B (160 in FIG. 1B)) ends and the actual period budget (e.g. Period Budget A (130 in FIG. 1B)) is generated. In one or more embodiments, the budget analyzer (103) is configured to determine whether period balances in accounting periods leading to the scheduled purchase period are sufficient to support the inclusion of the target item specification (121), i.e., the corresponding categorized expense entry (e.g. Expense Entry C (196 in FIG. 1B)), in the period budget (e.g. Period Budget C (190 in FIG. 1B)). In one or more embodiments, the budget analyzer (103) is configured to determine whether the period balance (e.g. Period Balance C (191 in FIG. 1B)) and other period balances in accounting periods subsequent to the scheduled purchase period stay positive with the inclusion of the target item specification (121) in the period budget (e.g. Period Budget C (190 in FIG. 1B)). In one or more embodiments, the budget analyzer (103) is configured to determine whether external financing is required to support the inclusion of the target item specification (121) in the period budget (e.g. Period Budget C (190 in FIG. 1B)).

Continuing with FIG. 1A, the candidate item monitor (102) is configured to search for products, services, or other items from the e-commerce merchants (111) to be considered for purchase to meet the requirement of the target item specification (121) in accordance with one or more embodiments of the invention. For example, the purchase candidates (e.g. represented by candidate item information (112), alternative candidate item information (116), or other candidate item information) may be products, services, or other items offered by the e-commerce merchants (111) and identified as candidates for purchase. In one or more embodiments, candidate item information of purchase candidates (e.g. candidate item information (112), alternative candidate item information (116), or other candidate item information) may be obtained from the e-commerce merchants (111). For example, the candidate item information (112) may include a candidate item description (113) and a candidate item price (114) where the candidate item description (113) describes the name, type, model, version, specification, and/or other characteristics of the candidate item information (112) and the candidate item price (114) is the price offered by the e-commerce merchants (111) for the corresponding candidate item. In one or more embodiments, the candidate item information (112) may optionally include a promotion expiration (115) indicating the expiration date of a promotional price offered by the e-commerce merchants (111) on the candidate item price (114).

In one or more embodiments of the invention, the candidate item monitor (102) is configured to obtain the candidate item information of purchase candidates (e.g. candidate item information (112), alternative candidate item information (116), or other candidates) based on the target item description (122) of the target item specification (121). For example, the candidate item information (112) may be identified by matching the corresponding candidate item description (113) and candidate item price (114) to the target item description (122) and the target price (124), respectively, based on a pre-determined criterion. Accordingly, the corresponding candidate item price (114) may be included in the budget (126) via the budget generator (107) as described above.

In one or more embodiments, the pre-determined criterion may be based on the flexibility level (125). For example, the flexibility level (125) may relate to a price threshold (e.g., 5%, 10%, $100, $1000, or other thresholds) by which the candidate item price (114) cannot exceed the target price (124). In addition, the flexibility level (125) may relate to an optional feature list in which the candidate item description (113) and the target item description (122) may be allowed to differ without breaching the requirement of the target item specification (121). In one or more embodiments, the pre-determined criterion may be conditionally based on a trade-off between the price variance and the optional feature list. For example, one or more features in the optional feature list may not be required in the identified candidate item information (112) if, as a result, the candidate item price (114) can be reduced by a pre-determined amount (e.g., 5%, 10%, $100, $1000, or other amounts).

From time to time, the e-commerce merchants (111) may conduct a sales promotion or other price adjustment activities, for example due to market competition, technology maturity, etc. In one or more embodiments of the invention, the candidate item monitor (102) is configured to monitor the e-commerce merchants (111) to obtain an updated price (e.g., candidate item price (114)) of an identified purchase candidate (e.g., represented by candidate item information (112)) for updating the budget (126) via the budget generator (107). In one or more embodiments, the candidate item monitor (102) is configured to monitor the e-commerce merchants (111) to periodically identify an alternative candidate item information (116) that may become more attractive than the initially identified candidate item information (112). Accordingly, the alternative candidate item information (116) may be obtained for the budget (126) to be incorporated via the budget generator (107).

As discussed above, the budget analyzer (103) may determine that external financing is required to support the inclusion of the target item specification (121) in the period budget (e.g. Period Budget C (190 in FIG. 1B)). In one or more embodiments of the invention, the financing analyzer (104) is configured to search for and select a financing plan, for example from the financing provider (109) to support such purchase. For example, the financing provider (109) may be the financial institution (108) where the user (106) already holds financial accounts or any other lending institutions that are available to the user (106). In one or more embodiments of the invention, the selected financing plan may include (i) an initial payment amount to substitute the target price (124) assigned to the amount (e.g. Amount EC (194 in FIG. 1B)) and (ii) additional recurring payments allocated to subsequent accounting periods to meet the requirement of the financing plan. In one or more embodiments, the financing analyzer (104) is configured to provide the initial payment amount and the recurring payment amount(s) to the budget generator (107) for including in the budget (126). In one or more embodiments of the invention, the financing analyzer (104) is configured to monitor the financing plan offerings from the financing provider (109) and provide updated initial payments and recurring payment information for the budget (126) when the terms of the selected financing plan change or other more attractive financing plans become available.

In one or more embodiments of the invention, the purchase monitor (101) is configured to submit to the user (106) various results generated by the candidate item monitor (102), the budget analyzer (103), and the financing analyzer (104) described above. In one or more embodiments, such results may be submitted automatically, based on user activation, according to a pre-defined schedule, upon the occurrence of an event, or combinations thereof. For example, the results may be submitted automatically to the user in a pop-up window, via an email or text message as well as be retrieved by the user via a command in a drop down menu or other suitable user interface. Further, the results may be made available on a daily, weekly, monthly, or quarterly basis as well as when a price reduction or budget change occurs. Furthermore, an alert (e.g., email alert, text message alert, or other alert signal) may be generated and sent to the user (106) when an update of the result becomes available.

In one or more embodiments of the invention, portions or the entire budget generator (107) may be included in an accounting or financial software of the user (106). In such an embodiment, the purchase monitor (101) may be a stand alone software, a built-in module, an optional add-on module, or a separate software suite component of the accounting or financial software. For example, the purchase monitor (101) may exchange necessary data with the budget generator (107) using a pre-defined application programming interface of the accounting or financial software. In one or more embodiments, the purchase monitor (101) may be offered to the user (106) from the provider of the accounting or financial software, the e-commerce merchants (111), the financial institution (108), or the financing provider (109). For example, the purchase monitor (101) may be offered from these sources to promote user loyalty. In one or more embodiments, the purchase monitor (101) may be provided to the e-commerce merchants (111), the financial institution (108), or the financing provider (109) by the provider of the accounting or financial software for offering to the user (106) in promoting user loyalty to the e-commerce merchants (111), the financial institution (108), or the financing provider (109). For example, the purchase monitor (101) may be provided to the e-commerce merchants (111), the financial institution (108), or the financing provider (109) by the provider of the accounting or financial software under certain joint marketing programs or other forms of fee-based or goodwill-based business agreements.

Figure 2:
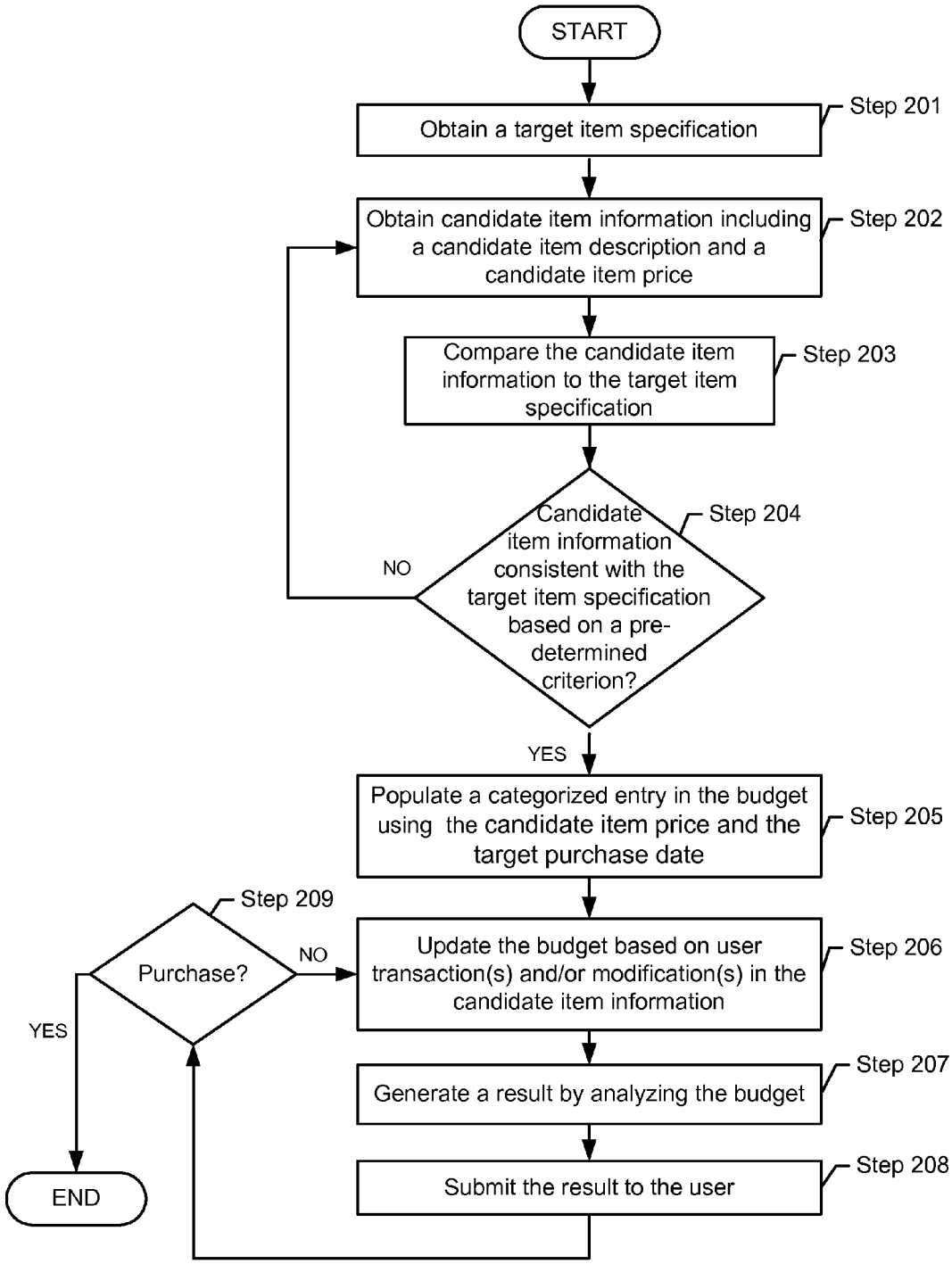
FIG. 2 depicts a flowchart of a method in accordance with one or more embodiments of the invention.

FIG. 2 depicts a flowchart of a method in accordance with one or more embodiments of the invention. In one or more embodiments of the invention, one or more of the steps shown in FIG. 2 may be omitted, repeated, and/or performed in a different order. Accordingly, embodiments of the invention should not be considered limited to the specific arrangements of steps shown in F FIG. 2.

In one or more embodiments of the invention, the method depicted in FIG. 2 may be practiced using system (100) described with respect to FIGS. 1A-1B above. In Step 201, a target item specification may be obtained, for example, by the purchase monitor described with respect to FIG. 1A above. In one or more embodiments of the invention, the target item specification includes a target item description, a target purchase date, and a target price. Generally speaking, the target item description describes the name, type, model, version, specification, and/or other requirements of an item (e.g., a product, service, or other types of item). For example, the target item description may be related to the item for purchase by the target purchase date by paying no more than the target price. Furthermore, the purchase may be related to an individual, a business, or other entity. In one or more embodiments, the target item is associated with a flexibility level. The flexibility level relates to the level of individual's or business entity's interest or desire (e.g., high, medium, low, strong, weak, heavy, light, or other flexibility level) in requiring the exact specification of the item for purchase, the exact date that the purchase has to be made, and the exact upper limit of a price to be paid for the purchase.

In Step 202, candidate item information is obtained using a processor of a computer system (as shown in FIG. 4) based on the target item description of the target item. The candidate item information is related to products, services, or other items that may be considered for purchase to meet the requirement of the target item specification. For example, the candidate item information includes a candidate item description and a candidate item price where the candidate item description describes a product, service, or other items (e.g., the name, type, model, version, specification, and/or other requirements) identified as a candidate for purchase and the candidate item price is the price to be paid for purchasing the purchase candidate. In such case, the candidate item information may be obtained by the candidate item monitor described with respect to FIG. 1A above. In one or more embodiments of the invention, the candidate item information is obtained from an electronic commerce merchant that offers such products, services, or other items for sale. For example, the electronic commerce merchant may be an Internet shopping website or other e-commerce merchant that may be captive or open to the public.

In Step 203, the candidate item information is compared to the target item specification, for example based on a pre-determined criterion. In one or more embodiments, the pre-determined criterion may be based on the flexibility level associated with the target item specification. For example, the flexibility level may relate to a price threshold (e.g., 5%, 10%, $100, $1000, or other threshold) by which the candidate item price cannot exceed the target price. In addition, the flexibility level may relate to an optional feature lists in which the candidate item description and the target item description may be allowed to differ without breaching the requirement of the target item specification. In one or more embodiments, the pre-determined criterion may be conditionally based on a trade-off between the candidate item price and the optional feature list. For example, one or more features in the optional feature list may not be required in the identified purchase candidate if, as a result, the candidate item price can be reduced by a pre-determined amount (e.g., 5%, 10%, $100, $1000, or other amount).

In Step 204, a determination is made as to whether the candidate item information matches the target item specification based on the pre-determined criterion described above. If the match is determined to be insufficient, the method returns to Step 202 where another purchase candidate (i.e., an alternative purchase candidate) may be searched and selected based on the target item specification to obtain an alternative candidate item information. For example, the scope of the e-commerce merchants (111) may be broadened in the search to identify another suitable purchase candidate. Returning to Step 204, if the match is determined to be sufficient based on the pre-determined criterion, the method proceeds to Step 205.

In Step 205, a categorized entry in the budget is populated using the candidate item price and the target purchase date when the candidate item price is no more than the target price. Accordingly, the candidate item price and the target purchase date are included in a budget where a portion of the budget is designated for the target item. For example, the budget may be generated, by the budget generator described with respect to FIG. 1A above, based on user input and/or historic income/expense data of the user. In such case, the budget may include planned incomes and expenses in multiple consecutive accounting periods of the budget cycle where the scheduled purchase for the item (i.e., the target purchase date) is designated in one of the accounting periods.

As discussed with respect to FIG. 1B above, the budget may include period budgets ordered in a sequence corresponding to the consecutive accounting periods. In addition, the period budgets may be categorized based on at least a portion of pre-defined categories. In one or more embodiments, the budget may be modified to focus on various aspects of the incomes and expenses of the user. For example, certain pre-defined categories may be selected by the user to be included in or excluded from the budget.

Further, each period budget may include a period income budget with categorized income entries, a period expense budget having categorized expense entries, and a period balance. For example, the period balance may be derived recursively from the period income budget, the period expense budget, and an initial balance at the beginning of the budget cycle.

Furthermore, the budget may be updated, by the budget generator described with respect to FIG. 1A above, to reflect actual income/expense data that occur or are accrued in an accounting period. For example, the period balance of one or more period budgets may be adjusted to reflect the actual income/expense data of one or more prior accounting periods. In one or more embodiments of the invention, the budget is monitored as such budget updates occur throughout the budget cycle.

In one or more embodiments of the invention, the candidate item price is included in a categorized expense entry of a period budget according to the target purchase date of the target item. In such case, the candidate item price and the target purchase date is included in the budget at the request of the purchase monitor described with respect to FIG. 1A, that is configured with an interface to access the information managed by the budget generator executing on a processor of a computer system.

In one or more embodiments of the invention, the categorized entry of the purchase candidate is included in the budget by (i) adding a target item category to the pre-defined categories, (ii) adding the target price to the period budget associated with an accounting period (i.e., the scheduled purchase period) in which the target purchase date of the target item falls, (iii) associating the target price to the target item category, and (iv) assigning the candidate item price to the target price in the categorized entry.

In Step 206, the budget is updated. As described above, the budget may be updated, by the budget generator described with respect to FIG. 1A above, to reflect actual income/expense data that occur or are accrued in an accounting period. Further, from time to time, the electronic commerce merchants may conduct a sales promotion or other price adjustment activities, for example due to market competition, technology maturity, etc. In one or more embodiments of the invention, changes in candidate item information may be monitored, by the candidate item monitor described with respect to FIG. 1A above, to obtain an updated price or description for the identified purchase candidate. In one or more embodiments, the budget may be further updated by incorporating the changes in the candidate item information into the categorized entry of the purchase candidate to generate a further updated budget. Accordingly, the budget is updated when actual income/expense of the user occurs or is accrued as well as when changes in identified candidate item information are detected and obtained. In one or more embodiments, the monitoring and/or updating occurs regularly (e.g., per second, hourly, daily, weekly, monthly, quarterly, or based on other periodic basis) or continuously. In one or more embodiments, the candidate item information may optionally include a promotion expiration indicating the expiration date of a promotional price offered by the e-commerce merchants. In such an embodiment, the expiration date is checked against the target purchase date such that a valid price is included in the further updated schedule.

In Step 207, a result is generated by analyzing the budget. In one or more embodiments of the invention, the budget is analyzed to determine whether period balances in accounting periods leading to the scheduled purchase period are sufficient (based on a pre-defined threshold) to support the inclusion of the categorized entry in the period budget of the scheduled purchase period. In one or more embodiments, the analyzing occurs regularly (e.g., per second, hourly, daily, weekly, monthly, quarterly, or based on other periodic basis) or continuously. For example, the result of the analysis may include accounting periods showing a marginal trend of period balances to support the purchase of the candidate item. In one or more embodiments, the budget is regularly analyzed to determine whether the period balances in the scheduled purchase period and accounting periods subsequent to the scheduled purchase period stay positive with the inclusion of the categorized entry in the period budget of the scheduled purchase period. For example, the result of the analysis may include accounting periods showing negative period balances as a result of supporting the purchase of the candidate item.

In one or more embodiments, the result may include a notification that the purchase of the candidate item cannot be achieved according to the target purchase date of the target item specification, for example because a marginal trend of period balances in accounting periods leading to the scheduled purchase period are insufficient (based on a pre-defined threshold) to support the purchase of the candidate item and/or the period balances in the scheduled purchase period and accounting periods subsequent to the scheduled purchase period do not stay positive with sufficient margin (based on a pre-defined threshold). This may be a result of actual income being below budgeted income, actual expense exceeding budgeted expense, and/or lack of anticipated price reduction of the purchase candidate.

In one or more embodiments, the result may include a notification that the scheduled purchase of the candidate item may be delayed, for example because a marginal trend of period balances in accounting periods leading to the scheduled purchase period are less than sufficient (based on a pre-defined threshold) to support the purchase of the candidate item and/or the period balances in the scheduled purchase period and accounting periods subsequent to the scheduled purchase period stay positive with less than sufficient margin (based on a pre-defined threshold).

In one or more embodiments, the result may include a confirmation that the purchase of the candidate item can be achieved according to the target purchase date of the target item specification, for example because the pattern of period balances in accounting periods leading to the scheduled purchase period are sufficient to support the purchase of the candidate item and/or the period balances in the scheduled purchase period and accounting periods subsequent to the scheduled purchase period stay positive with sufficient margin (based on a pre-defined threshold).

In one or more embodiments, the result may include a notification that the candidate item may be purchased ahead of the target purchase date of the target item specification, for example in an accounting period prior to the scheduled purchase period because the pattern of period balances in accounting periods leading to the scheduled purchase period are more than sufficient (based on a pre-defined threshold) to support the purchase of the candidate item and/or the period balances in the scheduled purchase period and accounting periods subsequent to the scheduled purchase period stay positive with more than sufficient margin (based on a pre-defined threshold). This may be a result of actual income exceeding budgeted income, actual expense being below budgeted expense, and/or substantial price reduction of the purchase candidate.

In one or more embodiments, the result may include a determination that external financing is required to achieve the purchase of the candidate item. In one or more embodiments of the invention, the financing analyzer, described with respect to FIG. 1A, may be used to search for and select a financing plan to support the purchase of the candidate item. For example, the selected financing plan may include an initial payment amount allocated to the scheduled purchase period and additional recurring payments allocated to subsequent accounting periods to meet the requirement of the financing plan. Accordingly, the budget may be updated to include the initial payment amount and the additional recurring payments. In one or more embodiments, the financing plan offerings from the financing providers may be regularly monitored to update initial payments and recurring payments in the budget when the terms of the selected financing plan change or other more attractive financing plans become available. In such an embodiment, the budget is regularly analyzed to confirm whether period balances are sufficient (based on a pre-defined threshold) to support the inclusion of the financing plan payments.

Consistent with the description above, in one or more embodiments of the invention, the budget is regularly analyzed when actual income/expense of the user occur or are accrued, when changes in identified candidate item information are detected and obtained, and/or when financing plan is included and the payment terms changes.

In Step 208, the results of analyzing the budget described above are submitted to the user for formulating a decision regarding whether to purchase the candidate item. As described with respect to FIG. 1A, such results may be submitted automatically, based on user activation, according to a pre-defined schedule, upon the occurrence of an event, or combinations thereof. For example, the results may be submitted automatically to the user in a pop-up window, via an email or text message as well as be retrieved by the user via a command in a drop down menu or other suitable user interface. Further, the results may be made available on a daily, weekly, monthly, or quarterly basis as well as when a price reduction induced budget change occurs. Furthermore, an alert (e.g., email alert, text message alert, etc.) may be generated and sent to the user when an update of the result becomes available. In such an embodiment, a notification that the purchase candidate can now be purchased is sent to the user when the period balance matches the updated candidate item price with sufficient margin based on a pre-defined threshold.

In Step 209, a decision is made by the user based on the result as to whether the purchase should be conducted. If the decision is no, then the method returns to Step 206 and continues in the loop of Steps 206 through 209 until the decision becomes yes and then the method ends.

Figure 3A:
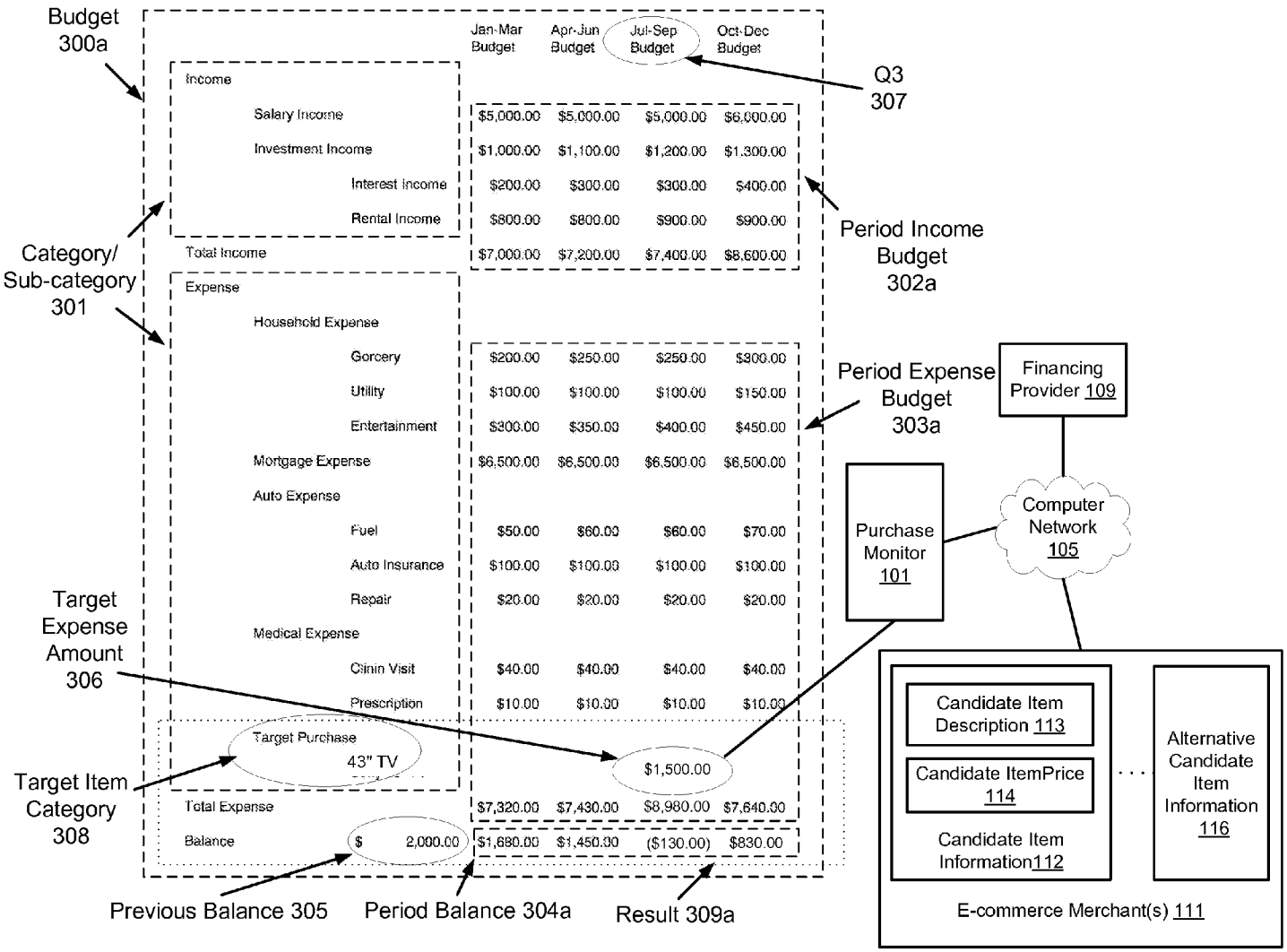
FIGS. 3A-3B depict an example in accordance with one or more embodiments of the invention.

FIG. 3A depicts a diagram showing an example use case of the invention in accordance with one or more embodiments of the invention. As shown in FIG. 3A, an annual budget (300*a*) has been created by a personal financial software used by an individual, John, that shows several line entries of incomes and expenses arranged in a table with four columns of quarterly period budgets labeled as "Jan-Mar Budget", "Apr-Jun Budget", "Jul-Sep Budget", and "Oct-Dec Budget" corresponding to the four quarterly accounting periods in the annual budget cycle. In addition, the annual budget (300*a*) includes the period balance (304*a*) of these four quarters.

As further shown in FIG. 3A, the line entries of incomes and expenses are categorized and arranged according to category/sub-category (301). Furthermore, the line entries of incomes and expenses are grouped into period income budget (302*a*) and period expense budget (303*a*). For example, the period income budget (302*a*) shows that John anticipates receiving a quarterly salary income of $5,000 in the first three quarters of the budget year and an increase to $6,000 in the fourth quarter. Similarly, the period expense budget (303*a*) show that John plans to spend $200 on grocery for the first quarter, $250 for each of the second and third quarters, and $300 for the fourth quarter. Further, the first quarterly budget is based on a previous balance (305) of $2000.

John has established a target item for a 43" TV to be purchased by the third quarter (307) at no more than $1,300 (not shown). The target item description of the target item is defined as 43" LCD TV with digital input capability, the target purchase date of the target item is defined as August 1, and the target price of the target item is defined as $1,300. John has also set a flexibility level that includes an acceptable price variance of $250 and the digital input capability being optional.

Using the purchase monitor (101) described above, this target item has been incorporated into the budget (300*a*) as a categorized expense entry in the third quarter period expense budget with a target expense amount (306) categorized as a sub-category of 43" TV under the target item category (308). The target expense amount (306) was initially set at $1,300 (not shown).

Using the candidate item monitor described above, a 43" TV of brand A model number X offered by certain one of the e-commerce merchants (111) at $1,500 is identified as the candidate item information (112). The price variance between the $1,300 target price and the $1,500 candidate item price is considered acceptable by the candidate monitor based on the flexibility level associated with the target item. Accordingly, the target expense amount (306) is updated as $1,500 and reflected in the now negative period balance (−$130) for the third quarter (307).

Using the budget analyzer described above, the result (309*a*) showing that at least one of the period balances (304*a*) is negative due to the inclusion of the 43" TV in the budget (300*a*) is generated and submitted to John for formulating a decision regarding the purchase. John believes that the price of LCD TVs is likely to be reduced during the summer season when announcements of new TV models are rumored. Further, John believes that the anticipated salary increase in the fourth quarter may occur earlier in the year and that he can start reducing his actual expense in the entertainment category to help saving for the purchase. Therefore John decides to continue the use of the purchase monitor (101) to monitor the budget (300*a*) with the inclusion of the planned 43" TV target item.

Figure 3B:
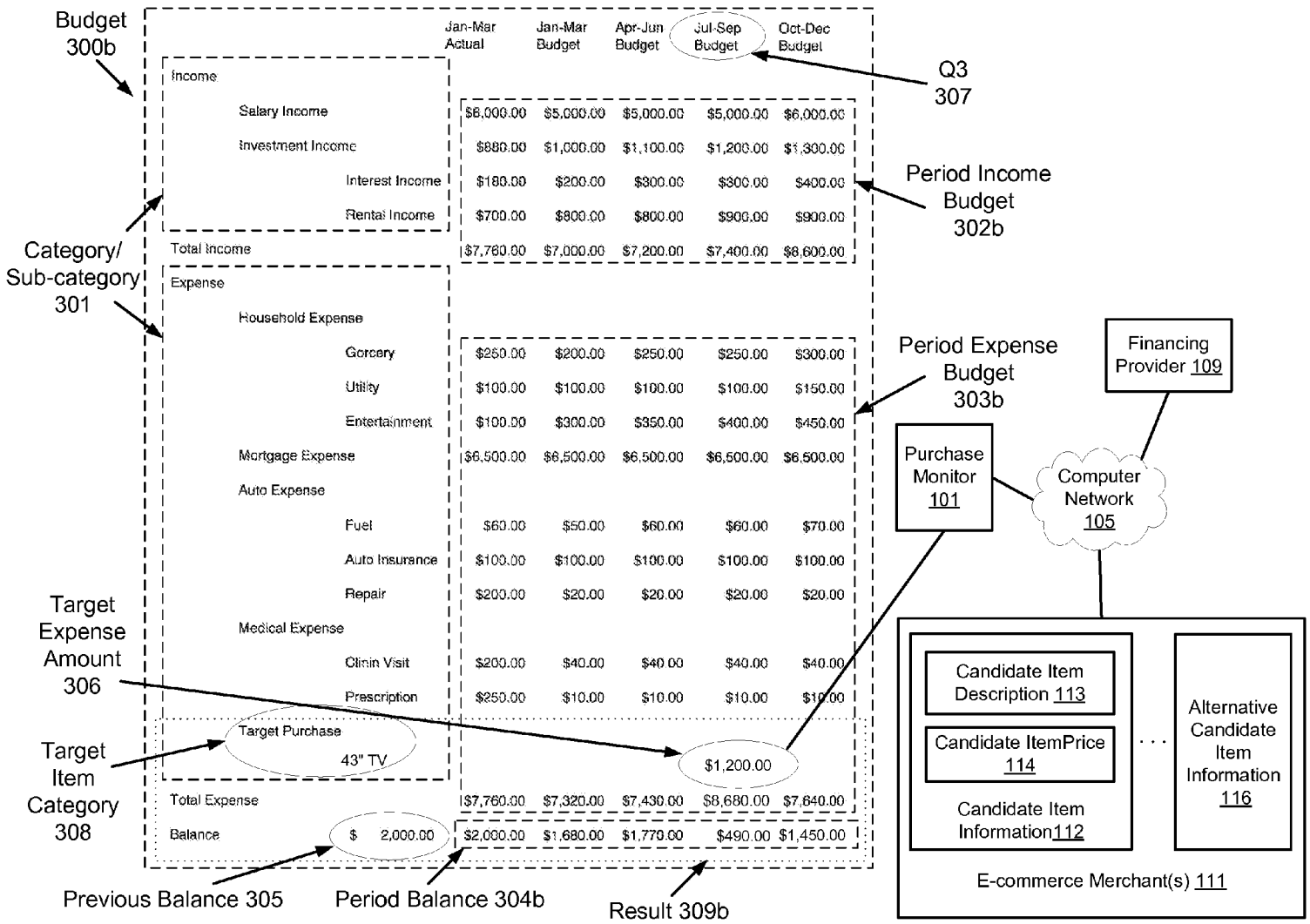

FIG. 3B depicts a diagram, in accordance with one or more embodiments of the invention, showing the example use case described in FIG. 3A above but captured at a later date. As shown in FIG. 3B, current time is in January and the budget (300*a*) has been updated to the budget (300*b*) at the end of the first quarter to include an additional column of the actual period budget for the first quarter labeled as "Jan-Mar Actual." A comparison between the actual period budget to the initially created period budget in the first quarter shows that the anticipated salary increase has indeed been accelerated to occur effective the beginning of the first quarter. In addition, John's effort of reducing entertainment expense has been realized to reduce the initially budgeted amount of $300 to the actual expense of $100 with a saving of $200. However, unexpected variances in the sub-categories of interest income, rental income, grocery expense, auto repair, and medical expense also occurred in the first quarter to offset the saving in the entertainment category. Fortunately, the candidate monitor obtains a price change information regarding the candidate item information (112) that has been automatically monitored. The price change information indicates that the candidate item price (114) of the brand A model number X 43" TV has been reduced to $1,200.

Using the purchase monitor described above, this price change information has been incorporated into the budget (300*b*) and reflected in the now positive period balance ($490) for the third quarter (307). Using the budget analyzer described above, the result (309*b*) is generated that shows the pattern of the period budgets for quarters (i.e., first and second quarters) leading to the scheduled purchase quarter (i.e., the third quarter) are sufficient (e.g., based on the pre-defined threshold of more than $400 margin in excess of the target expense amount) to support purchasing the 43" TV in the third quarter. The result (309*b*) also shows that the period balances in the scheduled purchase period (i.e., the third quarter) and accounting periods (i.e., the fourth quarter) subsequent to the scheduled purchase period stay positive with sufficient margin (e.g., based on the pre-defined threshold of more than $400 in positive).

The purchase monitor (101) then submits the result (309*b*) to John for formulating a decision regarding the purchase. John notices that not only the 43" TV can be purchased on schedule in the third quarter, the patterns in the period balances supports purchasing the 43" TV in the second quarter. In particular, the period budget of the second quarter shows $1,770, which is more than $400 in excess of the new price ($1,200) obtained by the purchase monitor. Therefore, John decides to move forward in purchasing the 43" TV in the second quarter.

Furthermore, an additional example is described below as a variation of the above scenario. For example, the new price $1,200 obtained by the purchase monitor (101) turns out to be a promotional price that expires by end of June for a 43" TV with no digital input capability. Using the budget analyzer, a what-if analysis is performed automatically to analyze the scenario (not shown) of moving the categorized expense entry for the 43" TV from the third quarter period expense budget to the second quarter period expense budget to take advantage of the promotional price. The specification difference in the digital input capability is considered acceptable by the purchase monitor (101) based on the flexibility level associated with the target item. Accordingly, a result is generated and submitted to John showing that indeed the 43" TV can be purchased in the second quarter in an expedient manner benefitting from the time sensitive new pricing.

Embodiments of the invention may be implemented on virtually any type of computer regardless of the platform being used. For example, as shown in FIG. 4, a computer system (400) includes one or more processor(s) (402) (such as a central processing unit (CPU) or other hardware configured to allow execution of software instructions), associated memory (404) (e.g., random access memory (RAM), cache memory, flash memory, etc.), a storage device (406) (e.g., a hard disk, an optical drive such as a compact disk drive or digital video disk (DVD) drive, a flash memory stick, etc.), and numerous other elements and functionalities typical of today's computers (not shown). The computer system (400) may also include input means, such as a keyboard (408), a mouse (410), or a microphone (not shown). Further, the computer system (400) may include output means, such as a monitor (412) (e.g., a liquid crystal display (LCD), a plasma display, or cathode ray tube (CRT) monitor). The computer system (400) may be connected to a network (414) (e.g., a local area network (LAN), a wide area network (WAN) such as the Internet, or any other similar type of network) with wired and/or wireless segments via a network interface connection (not shown). Those skilled in the art will appreciate that many different types of computer systems exist, and the aforementioned input and output means may take other forms. Generally speaking, the computer system (400) includes at least the minimal processing, input, and/or output means necessary to practice embodiments of the invention.

Further, those skilled in the art will appreciate that one or more elements of the aforementioned computer system (400) may be located at a remote location and connected to the other elements over a network (414). Further, embodiments of the invention may be implemented on a distributed system having a plurality of nodes, where each portion of the invention (e.g., various modules of FIGS. 1A and/or 1B) may be located on a different node within the distributed system. In one embodiments of the invention, the node corresponds to a computer system. Alternatively, the node may correspond to a processor with associated physical memory. The node may alternatively correspond to a processor with shared memory and/or resources. Further, software instructions for performing embodiments of the invention may be stored on a computer readable medium such as a compact disc (CD), a diskette, a tape, or any other computer readable storage device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for conducting a purchase, comprising:

obtaining a target item specification for purchasing a target item, wherein the target item specification comprises a target item description, a target purchase date, and a target price;

obtaining, using a central processing unit (CPU), candidate item information related to a candidate item found on a merchant site consistent with the target item specification, wherein the candidate item information comprises a candidate item description and a candidate item price;

populating, by the CPU without user intervention and in response to determining that the candidate item price is no more than the target price, a categorized entry in a user budget using the candidate item price and the target purchase date;

obtaining, by the CPU subsequent to populating the categorized entry in the user budget, an updated candidate item price by repetitively monitoring the merchant site using the CPU without user intervention;

updating, using the CPU without user intervention and in response to obtaining the updated candidate item price, the user budget based on the updated candidate item price;

generating, subsequent to updating the user budget, a result by analyzing, using the CPU without user intervention, the user budget with respect to the categorized entry; and submitting, by the CPU, the result to a user for formulating a decision regarding whether to purchase the candidate item.

2. The method of claim 1, further comprising:

updating, using the CPU, the user budget based on user transactions.

3. The method of claim 2, wherein the user budget comprises a plurality of consecutive accounting periods and is updated to generate an updated user budget to reflect actual income/expense data of an accounting period of the plurality of consecutive accounting periods, wherein the candidate item information is obtained from an electronic commerce merchant and the user budget is further updated to generate a further updated user budget when the candidate item price is updated by the electronic commerce merchant, and wherein analyzing the user budget comprises analyzing the updated user budget and the further updated user budget.

4. The method of claim 3, wherein the user budget is determined based on at least one selected from a group consisting of user input and historic income/expense data of the user, the historic income/expense data comprising a plurality of categories, wherein the user budget comprises a plurality of period budgets ordered in a sequence corresponding to the plurality of consecutive accounting periods, each of the plurality of period budgets being categorized based on at least a portion of the plurality of categories and comprising a period income budget, a period expense budget, and a period balance derived recursively from the period income budget, the period expense budget, and an initial balance, and wherein the user budget is updated to generate the updated user budget by adjusting the period balance of at least a portion of the plurality of period budgets to reflect the actual income/expense data of the accounting period.

5. The method of claim 4, wherein populating the categorized entry in the user budget comprises:

adding a target item category to the plurality of categories;

adding the target price to a period budget of the plurality of period budgets according to the target purchase date;

associating the target price to the target item category, and assigning the candidate item price to the target price.

6. The method of claim 5, wherein the result comprises an effect to at least one period balance in the plurality of period budgets due to the categorized entry.

7. The method of claim 5, further comprising:

obtaining a financing plan for conducting the purchase based on the candidate item price, wherein the financing plan comprises an initial payment and a plurality of recurring payments allocated to a portion of the plurality of accounting periods based on the target purchase date, and wherein the result comprises an effect to at least one period balance in the plurality of period budgets due to at least one of the initial payment and the plurality of recurring payments.

8. A non-transitory computer readable medium storing instructions when executed by the computer comprising functionalities for:

obtaining a target item specification for purchasing a target item, wherein the target item specification comprises a target item description, a target purchase date, and a target price;

obtaining, using a central processing unit (CPU), candidate item information related to a candidate item found on a merchant site consistent with the target item specification, wherein the candidate item information comprises a candidate item description and a candidate item price;

populating, by the CPU without user intervention and in response to determining that the candidate item price is no more than the target price, a categorized entry in a user budget using the candidate item price and the target purchase date;

obtaining, by the CPU subsequent to populating the categorized entry in the user budget, an updated candidate item price by repetitively monitoring the merchant site using the CPU without user intervention;

updating, using the CPU without user intervention and in response to obtaining the updated candidate item price, the user budget based on the updated candidate item price;

generating, subsequent to updating the user budget, a result by analyzing, using the CPU without user intervention, the user budget with respect to the categorized entry; and submitting, by the CPU, the result to a user for formulating a decision regarding whether to purchase the candidate item.

9. The non-transitory computer readable medium of claim 8, wherein the instructions when executed by the computer further comprises functionalities for:

updating, using the CPU, the user budget based on a modification of the candidate item information.

10. The non-transitory computer readable medium of claim 9, wherein the user budget comprises a plurality of consecutive accounting periods and is updated to generate an updated user budget to reflect actual income/expense data of an accounting period of the plurality of consecutive accounting periods, wherein the candidate item information is obtained from an electronic commerce merchant and the user budget is further updated to generate a further updated user budget when the candidate item price is updated by the electronic commerce merchant, and wherein analyzing the user budget comprises analyzing the updated user budget and the further updated user budget.

11. The non-transitory computer readable medium of claim 10, wherein the user budget is determined based on at least one selected from a group consisting of user input and historic income/expense data of the user, the historic income/expense data comprising a plurality of categories, wherein the user budget comprises a plurality of period budgets ordered in a sequence corresponding to the plurality of consecutive accounting periods, each of the plurality of period budgets being categorized based on at least a portion of the plurality of categories and comprising a period income budget, a period expense budget, and a period balance derived recursively from the period income budget, the period expense budget, and an initial balance, and wherein the user budget is updated to generate the updated budget by adjusting the period balance of at least a portion of the plurality of period budgets to reflect the actual income/expense data of the accounting period.

12. The non-transitory computer readable medium of claim 11, wherein populating the categorized entry in the user budget comprises:

adding a target item category to the plurality of categories;

adding the target price to a period budget of the plurality of period budgets according to the target purchase date;

associating the target price to the target item category; and assigning the candidate item price to the target price.

13. The non-transitory computer readable medium of claim 12, wherein the result comprises an effect to at least one period balance in the plurality of period budgets due to the categorized entry.

14. The non-transitory computer readable medium of claim 12, further comprising:

obtaining a financing plan for conducting the purchase based on the candidate item price, wherein the financing plan comprises an initial payment and a plurality of recurring payments allocated to a portion of the plurality of accounting periods based on the target purchase date, and wherein the result comprises an effect to at least one period balance in the plurality of period budgets due to at least one of the initial payment and the plurality of recurring payments.

15. A system for conducting a purchase, comprising:

an electronic commerce merchant accessible via a computer network and comprising candidate items for purchase by a user;

a budget generator executing on a central processing unit (CPU) and configured to generate a user budget for the user;

a candidate item monitor executing on the CPU and configured to obtain candidate item information related to a candidate item of the electronic commerce merchant consistent with a target item specification for purchasing a target item, wherein the target item specification comprises a target item description, a target purchase date, and a target price, wherein the candidate item information comprises a candidate item description and a candidate item price;

a memory storing instructions when executed by the CPU comprising functionalities for:

populating, without user intervention and in response to determining that the candidate item price is no more than the target price, a categorized entry in a user budget using the candidate item price and the target purchase date;

obtaining, subsequent to populating the categorized entry in the user budget, an updated candidate item price by repetitively monitoring the merchant site using the CPU without user intervention;

updating, without user intervention and in response to obtaining the updated candidate item price, the user budget based on the updated candidate item price;

generating, subsequent to updating the user budget, a result by analyzing, without user intervention, the user budget with respect to the categorized entry; and submitting the result to the user for formulating a decision regarding whether to purchase the candidate item.

16. The system of claim 15, wherein the instructions when executed by the CPU further comprises functionalities for updating, using the CPU, the user budget based on user transactions.

17. The system of claim 16, wherein the budget analyzer is further configured to:

update the user budget to generate an updated user budget to reflect actual income/expense data of an accounting period of a plurality of consecutive accounting periods of the budget, and further update the user budget to generate a further updated user budget when the candidate item price is updated by the electronic commerce merchant, wherein analyzing the user budget comprises analyzing the updated user budget and the further updated user budget.

18. The system of claim 17, further comprising a financial institution comprising one or more accounts of the user, wherein the budget generator is configured to generate the user budget based on at least one selected from a group consisting of user input and historic income/expense data of the user, wherein the historic income/expense data is obtained from the financial institution of the user and comprises a plurality of categories, wherein the user budget comprises a plurality of period budgets ordered in a sequence corresponding to the plurality of consecutive accounting periods, each of the plurality of period budgets being categorized based on at least a portion of the plurality of categories and comprising a period income budget, a period expense budget, and a period balance derived recursively from the period income budget, the period expense budget, and an initial balance, and wherein the user budget is updated to generate the updated user budget by adjusting the period balance of at least a portion of the plurality of period budgets to reflect the actual income/expense data of the accounting period.

19. The system of claim 18, wherein populating the categorized entry in the user budget comprises:

adding a target item category to the plurality of categories;

adding the target price to a period budget of the plurality of period budgets according to the target purchase date;

associating the target price to the target item category, and assigning the candidate item price to the target price.

20. The system of claim 19, further comprising a financing provider, wherein the instruction when executed by the processor further comprising functionalities for:

obtaining a financing plan for conducting the purchase based on the candidate item price, wherein the financing plan comprises an initial payment and a plurality of recurring payments allocated to a portion of the plurality of accounting periods based on the target purchase date, wherein the result comprises an effect to at least one period balance in the plurality of period budgets due to at least one of the initial payment and the plurality of recurring payments.

* * * * *